US007252286B2

(12) United States Patent
Bober

(10) Patent No.: US 7,252,286 B2
(45) Date of Patent: Aug. 7, 2007

(54) COMPACT PRINTER PAPER PATH MANUAL ACCESS IMPROVEMENT WITH COLLAPSIBLE AIR DUCTS

(75) Inventor: Henry T. Bober, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 507 days.

(21) Appl. No.: 10/863,723

(22) Filed: Jun. 8, 2004

(65) Prior Publication Data

US 2005/0269766 A1 Dec. 8, 2005

(51) Int. Cl.
*B65H 7/00* (2006.01)

(52) U.S. Cl. ..... 271/256; 271/264; 399/124

(58) Field of Classification Search ..... 271/264, 271/256, 258.04, 258.05, 257, 273, 198, 271/314; 399/92, 93, 124; 347/104
See application file for complete search history.

(56) References Cited

U.S. PATENT DOCUMENTS 5,749,039 A * 5/1998 Thomas ..... 399/397

6,985,677 B2 * 1/2006 Yamagata et al. ..... 399/18

* cited by examiner

*Primary Examiner*—Patrick Mackey
*Assistant Examiner*—Michael C McCullough
(74) *Attorney, Agent, or Firm*—James J. Ralabate; Paul F. Morgan

(57) ABSTRACT

Increased manual access spaces are provided even within a more compact printer for the movement or removal of printer components such as paper path baffles to be moved for the removal of jammed sheets and/or other hand or tool insertions by printer users and/or repair personnel. This is provided by automatically reducing the normal operating space occupied or required by at least one operative printer component during a machine shutdown in or near such desired manual access areas. In particular, by replacing at least part of at least one of the present rigid space-consuming air ducts or manifolds in a printer with a collapsible portion adjacent to at least one paper path jam clearance area or other desired manual access area which at least partially collapses upon printer shutdowns removing power from the blower for that air duct to substantially increase unobstructed manual access.

1 Claim, 2 Drawing Sheets

COMPACT PRINTER PAPER PATH MANUAL ACCESS IMPROVEMENT WITH COLLAPSIBLE AIR DUCTS

Figure 1:
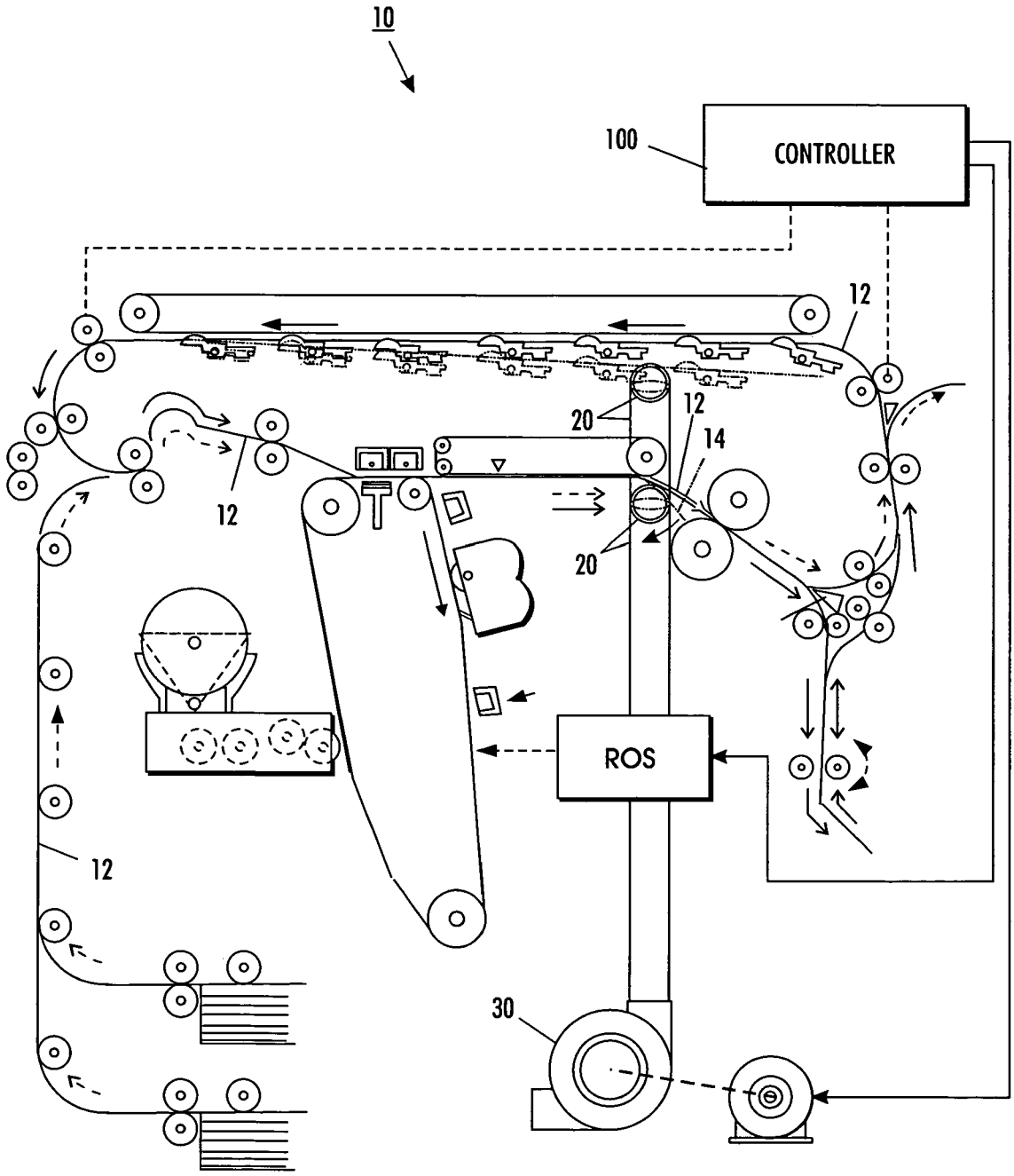

The design of printers for increased compactness and reduced "footprint" (floor space) has made user internal access to the paper path of a printer for jam clearance of print media sheets (which may be stopped or jammed in various locations along the paper path of the printer) an increasing machine designer and user challenge. Likewise, tech rep or other repair personal have more restricted manual access to removal or repair of internal components that are more closely crowded together in more compact printer designs. The disclosed embodiment provides for increased manual access spaces within even a more compactly designed printer for the movement of paper path sheet baffles for removals of jammed sheets and/or other printer components for manual access by printer users and/or repair personnel.

The disclosed embodiment accomplishes the above and other advantages in a low cost and simple in hindsight manner by automatically reducing the normal operating space occupied or required by at least one operative printer component during a machine shutdown in or near such desired manual access spaces. In particular, by replacing at least one of the present rigid space-consuming air ducts or manifolds in a printer with a collapsible such duct or manifold at or adjacent to at least one paper path jam clearance area or other desired manual access area.

The use of air ducts or manifolds in printers for various functions, including the cooling of heated components, such as the thermal fuser in a xerographic printer, is well known and need not be discussed in any detail herein. Another such known provision or application of internal air duct is to apply cooling and/or drying air to heated and/or damp sheets exiting a printer print engine. Positive air flows requiring internal air ducts can be desired for other known positions or internal components for printers as well. For example, for sheet separation and feeding of the print media sheets to be printed, for temperature and/or humidity control of the photoreceptor imaging member, especially for color printing stability, and/or for air flows controlling or directing the movement of contaminants within a printer towards or away from various locations, such as stray dry toner imaging material, ozone from corona generators, etc. These directed air flows may be associated with air filters.

A specific feature of the specific embodiments disclosed herein is to provide a printer with an elongated paper path for transporting print media sheets being printed by said printer in a printing operation, said elongated paper path having at least one user manual internal access area for manual access to at least one portion of said paper path for jam clearance removal of at least one of said print media sheets stopped in said at least one portion of said paper path, said printer having at least one air blower which is powered during said printing operation, said printer also having at least one air duct pneumatically connecting with said powered air blower during said printing operation to apply air pressure inside said air duct and to transport said air therein to at least one area of said printer during said printing operation, said at least one air duct having at least a section thereof at least partially obstructing said desired user manual internal access area for manual access to said at least one portion of said paper path during said printing operation, said at least one section of said at least one air duct being automatically at least partially collapsible by the removal of said air pressure inside said air duct other than during said printing operation to provide increased manual access space in said manual internal access area for said at least one portion of said paper path for said jam clearance removal of said at least one print media sheet stopped in said at least one portion of said paper path.

Further specific features disclosed in the embodiments herein, individually or in combination, include those wherein said at least one section of said at least one air duct comprises a flexible duct member which is sufficiently flexible to be automatically at least partially collapsed by automatic removal of power from said powered air blower upon the interruption of said printing operation; and/or wherein said at least one section of said at least one air duct is automatically partially collapsed by automatic removal of power from said powered air blower upon the detection by said printer of said least one of said print media sheets being stopped in at least one said portion of said paper path; and/or a more compact printer design for a printer with an paper path for transporting print media sheets being printed by said printer in a printing operation and with movable printer components requiring at least one manual internal access area for manual access to move at least one said movable printer components, said printer having at least one air blower which is powered during said printing operation, said printer also having at least one elongated air duct pneumatically connecting with said powered air blower during said printing operation to apply air pressure inside said air duct, said at least one elongated air duct transporting air therein from said powered blower to at least one area of said printer during said printing operation, said at least one elongated air duct having at least one section thereof which is at least partially obstructing said manual internal access area for manual access to move said at least one movable printer component during said printing operation, said at least one section of said at least one air duct being automatically at least partially collapsible by the removal of said air pressure inside said air duct other than during said printing operation to substantially increase said manual internal access area for manual access to move said at least one movable printer component; and/or wherein said at least one section of said at least one elongated air duct is automatically partially collapsed by automatic removal of power from said powered air blower upon the interruption of said printing operation; and/or a method of improved sheet jam clearance in a printer having an elongated paper path for transporting print media sheets being printed by said printer in a printing operation, said elongated paper path having at least one user manual internal access area for manual access to at least one portion of said paper path for jam clearance removal of at least one of said print media sheets stopped in said at least one portion of said paper path, said printer having at least one air blower which is powered during said printing operation, said printer also having at least one air duct pneumatically connecting with said powered air blower during said printing operation to apply air pressure inside said air duct and to transport said air therein to at least one area of said printer during said printing operation, said at least one air duct having at least a section thereof at least partially obstructing said desired user manual internal access area for manual access to said at least one portion of said paper path during said printing operation, automatically partially collapsing said at least one section of said at least one air duct by the removal of said air pressure inside said air duct other than during said printing operation to provide a substantially increased manual access space in said manual internal access area for said at least one portion of said paper path for said jam clearance removal of said at least one print media sheet stopped in said at least one portion of said paper path; and/or wherein said at least one section of said at least one air duct comprises a flexible duct member which is sufficiently flexible to be automatically at least partially collapsed by automatic removal of power from said powered air blower upon the interruption of said printing operation.

The disclosed system may be operated and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software or computer arts. Alternatively, any disclosed control functions may be implemented partially or fully in hardware, using standard logic circuits or single chip VLSI designs. The automatic shutdown of printer blowers at or after a paper jam or other machine fault requiring internal manual intervention is already accomplished by most existing printer controllers and their "cycle down" or "hard stop" software and/or hardware in well known manners, and thus need not be re-described herein.

The term "reproduction apparatus" or "printer" as used herein broadly encompasses various printers, copiers or multifunction machines or systems, xerographic or otherwise, unless otherwise defined in a particular claim. The term "sheet" herein refers to a usually flimsy physical sheet of paper, plastic, or other suitable physical print media substrate for images, whether precut or web fed. A "copy sheet" may be abbreviated as a "copy" or called a "hardcopy."

As to specific components of the subject apparatus or methods, or alternatives therefor, it will be appreciated that, as is normally the case, some such components are known per se in other apparatus or applications, which may be additionally or alternatively used herein, including those from art cited herein. For example, it will be appreciated by respective engineers and others that many of the particular component mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Figure 2:
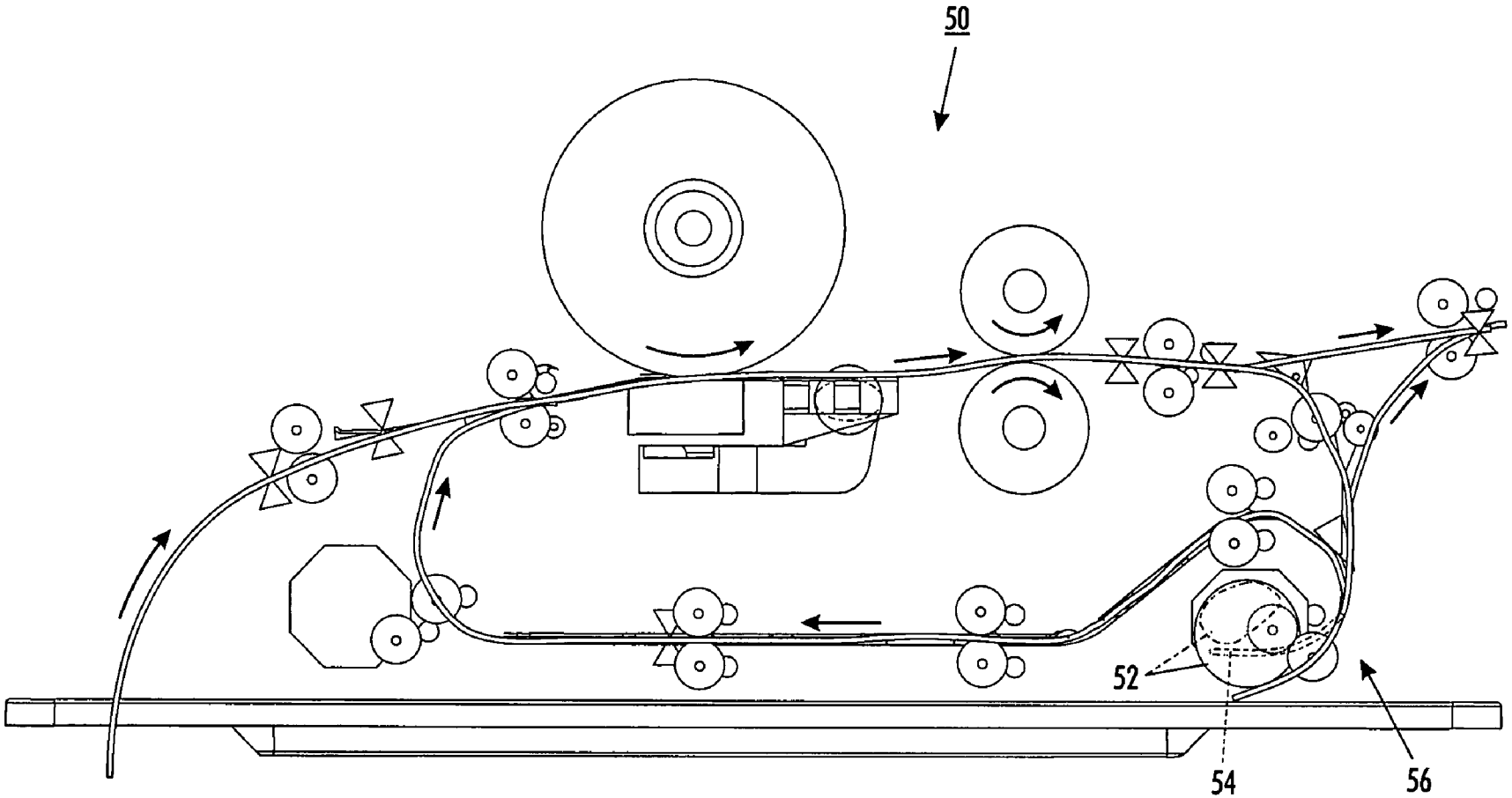

Above-mentioned and further features and advantages will be apparent to those skilled in the art from the specific apparatus and its operation or methods described in the example below, and the claims. Thus, the present invention will be better understood from this description of this one specific embodiment example, including the drawing figure (approximately to scale) wherein:

FIG. 1 is a schematic plan view of an otherwise conventional xerographic printer, merely as one example of a compact printer in which a disclosed automatically collapsible air duct sheet path manual access and clearance space enhancement system may be incorporated into a compact design, as shown by the example therein; and FIG. 2 shows a more compact printer example in which the exemplary collapsible duct creates previously unavailable usable space adjacent a sheet inverter.

Referring to FIG. 1, the illustrated printer 10 is merely one example of many types of xerographic printers, or other printers, having a paper path 12. Through which the print media sheets to be printed pass through and out of the printer 10. For illustration of one example of the advantages of the subject modification of the printer 10 there is shown an exemplary sheet jam clearance baffle 14, forming part of the exemplary paper path 12. It is typical and well known for plural such baffles, or other movable or repositionable printer components, to define the normal paper path 12 during normal printing operation. However, when certain printing machine failures occur, such as an unintended paper jam, the printer 10 is stopped or cycled down and the operator then typically opens exterior covers of the printer and reaches in to manually remove sheets from one or more locations along the paper path. This is illustrated in this example by the phantom open position of the baffle 14. The location of sheet jam detectors (sensors) along a printer paper path is also well know in the art and need not be re-described herein.

The FIG. 2 illustrated printer 50 likewise shows an inflated (and deflated) air duct 52, here shown adjacent a pivoting access baffle 54 for a sheet inverter 56. The following description of FIG. 1 largely applies to FIG. 2 as well.

Due to the desirably compact arrangement of components in a desirably more compact printer, it may be seen that in this first example of FIG. 1 a novel exemplary air duct 20, as shown in its solid line operating position, may be located close to the baffle 14 so as to conserve internal machine space. It may be seen that if this air duct 20 were a conventional rigid, fixed area, air duct, it would restrict the opening of the baffle 14 to a sufficiently extent to allow sufficient desired operator hand insertion space into the paper path 12 to remove a stopped or jammed sheet in that area.

This air duct 20 may conventionally supplied with relatively low positive pressure air in a conventional manner by a conventional electric motor driven blower 30, as schematically illustrated. Such blowers 30 are typically located in some other part of the machine, such as at the rear of the printer 10. Thus, it is not unusual for such air ducts as 20 to have to run through the interior of the printer 10 for a considerable distance to positions adjacent to the paper path 12 or over or under the paper path. Such air ducts could need to run under or over large components adjacent to the paper path, such as an inverter, which would also obstruct access to the paper path at that point and are not desirable to be moved by the operator for jam clearances.

As shown in phantom lines here, this novel air duct 20 is collapsible rather than rigid. It may be made with any suitable or conventional materials to that end, such as various known plastics that are sufficiently thin and flexible to at least partially self-collapse upon removal of the interior air pressure support in the duct 20 interior from the stopping of the blower 30. Alternatively, the duct 20 can made be of an elastic membrane, or of known plastic or thin metal materials that have shape tension memory causing them to likewise partially or fully collapse upon a printer 10 shut down or cycle down which automatically turns off electrical power to the blower 30.

The collapsible duct 20 reforms into its original, expanded, operating position shown in solid line when the machine is restarted for normal printing operations, after a jam is cleared or other repairs completed.

The self-collapsing of the duct 20 can be alternatively or additionally provided or aided by reversing the blower 30, for example, by the use of a blower 30 with a reversible DC fan motor. This can create a slight vacuum inside the pneumatic duct 20, which can assist or increase its collapse.

The automatic collapse of the duct 20 need only be in those sections or parts of the overall length of a duct such as 20 in which available or increased manual access inside the printer 10 is desired. Other sections of the duct may be conventionally rigid.

This automatic collapse of at least part of the duct 20 in desired manual access areas can provide considerable additional manual access space (in a space that otherwise occupied by the duct 20 during printing), for personnel to reach in for jam clearances or other printing recovery actions adjacent to the duct 20. In this FIG. 1 example, the duct 20 collapse also allows for a greatly increased swing-open position for the exemplary baffle 14 (as shown in phantom) which would otherwise have been obstructed by the duct 20.

The collapsible duct may be attached to a movable component such as a jam access door, or located in an adjacent access cavity.

The use of such a collapsible duct 20 can also or alternatively allow the design of a printer 10 with a larger cross-section air duct 20, yet still allow operator jam clearance access that would not be allowed by a comparable size rigid air duct. Increasing the available design cross-section of an air manifold or duct such as 20 can reduce air flow friction or impedance along the air duct 20. That may even reduce the size or power requirements for the particular blower 30 connected to that particular duct 20, and/or additional such air ducts, within the printer 10. The ability to provide increased diameter air ducts without increasing the size of the printer can reduce blower nose as well as blower power requirements by reduced duct impedance to air flow during operation.

As noted, the deflation of at least a part of the duct 20, and/or other such collapsible ducts in desired access spaces within the printer 10, is automatic upon a jam or other machine stoppage signal from the controller 100 of the printer 10. This system does not require any additional operator action or any additional components to provide any of the various above-described features and advantages.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A method of improved sheet jam clearance in a printer having an elongated paper path for transporting print media sheets being printed by said printer in a printing operation, said elongated paper path having at least one user manual internal access area for manual access to at least one portion of said paper path for jam clearance removal of at least one of said print media sheets stopped in said at least one portion of said paper path, said jam clearance removal of said at least one print media sheet comprising; pivoting of a sheet path defining baffle member in said at least one user manual internal access area, said printer having at least one air blower which is powered during said printing operation, said printer also having at least one air duct pneumatically connecting with said powered air blower during said printing operation to apply air pressure inside said air duct and to transport said air therein to at least one area of said printer during said printing operation, said at least one air duct having at least one collapsible section thereof which partially obstructs said desired user manual internal access area for manual access to said at least one portion of said paper path during said printing operation by the obstruction of said pivoting of said sheet path defining baffle member in said at least one user manual internal access area, and automatically partially collapsing said at least one collapsible section of said at least one air duct in response to a detection of a sheet jam in said paper path by the removal of said air pressure inside said air duct to allow said pivoting of said sheet path defining baffle member in said at least one user manual internal access area into a space previously occupied by said collapsible section of said air duct to provide a substantially increased manual access space in said manual internal access area for said at least one portion of said paper path for said jam clearance removal of said at least one print media sheet stopped in said at least one portion of said paper path.

* * * * *